US008069524B2

(12) United States Patent
Kraemer

(10) Patent No.: US 8,069,524 B2
(45) Date of Patent: Dec. 6, 2011

(54) TOOTHBRUSH

(75) Inventor: Hans Kraemer, Buehl (DE)

(73) Assignee: GlaxoSmithKline Consumer Healthcare GmbH & Co., Buehl (Baden) (DE)

( * ) Notice: Subject to any disclaimer, the term of this patent is extended or adjusted under 35 U.S.C. 154(b) by 1035 days.

(21) Appl. No.: 11/568,675

(22) PCT Filed: May 4, 2005

(86) PCT No.: PCT/EP2005/004959
§ 371 (c)(1),
(2), (4) Date: Oct. 30, 2007

(87) PCT Pub. No.: WO2005/107522
PCT Pub. Date: Nov. 17, 2005

(65) Prior Publication Data

US 2008/0168613 A1 Jul. 17, 2008

(30) Foreign Application Priority Data

May 7, 2004 (EP) ..... 04010962

(51) Int. Cl.
*A46B 9/04* (2006.01)

(52) U.S. Cl. ..... 15/167.1; 15/201

(58) Field of Classification Search ..... 15/208, 15/167.1, 201, 186, 190, 191.1, 207.2
See application file for complete search history.

(56) References Cited

U.S. PATENT DOCUMENTS

| | | | | |
|---|---|---|---|---|
| 3,082,457 | A | 3/1963 | Lucibello et al. | |
| 4,240,452 | A | 12/1980 | Jean | |
| 4,633,542 | A * | 1/1987 | Taravel | 15/167.1 |
| 5,823,633 | A | 10/1998 | Weihrauch et al. | |

FOREIGN PATENT DOCUMENTS

| | | | |
|---|---|---|---|
| DE | 4122524 | | 7/1992 |
| DE | 19902129 | | 1/1999 |
| EP | 0142885 | | 5/1985 |
| EP | 0159940 | | 10/1985 |
| EP | 0923326 | B1 * | 6/2003 |
| WO | WO-96/02165 | | 2/1996 |
| WO | WO98/43514 | | 10/1998 |
| WO | WO03/001943 | | 1/2003 |
| WO | WO 93/24034 | | 12/2003 |

* cited by examiner

*Primary Examiner* — Shay Karls
(74) *Attorney, Agent, or Firm* — Joshua C. Sanders; Nora L. Stein; Theodore R. Furman

(57) ABSTRACT

A brush head, in particular a toothbrush, with a base carrier (1) formed from a soft elastic material in which connecting elements comprising separate support rings (2) separated from one another and bearing a plurality of bristle tufts (4) are embedded, each of the rings having a bristle tuft threaded through. Preferably the bristle tuft can move axially in the support ring and is supported resiliently by the soft elastic material.

13 Claims, 2 Drawing Sheets

TOOTHBRUSH

This application is a §371 national phase entry of International Application No. PCT/EP2005/004959 filed May 4, 2005.

This invention relates to brushes, especially to brush heads. In particular the invention relates to the head of a toothbrush of the type having a base carrier formed from a soft elastic material in which there are embedded connecting elements separated from one another and bearing a plurality of bristle tufts, each of the said connecting elements embracing individual bristles tufts at their fixed end.

Toothbrushes are well known articles, and generally comprise a handle, and either fixedly or replaceably attached thereto a head from which project bristles, generally grouped in tufts of plural bristles, the bristles having a free end distant from the head and a fixed end retained in the head. For the purposes of this description the direction fixed end—toward—free end is termed "up", and derivative terms such as "upper" and "lower" are construed accordingly.

Toothbrush of the type having a head comprising a base carrier formed from a soft elastic material in which there are embedded a plurality of bristle tufts are known for example from WO-A-96/02165 and EP-0 923 326 B1. In the latter, cup-like holders surrounding individual bristle tufts are embedded in the base carrier formed from the soft elastic material, said holders completely surrounding the bristle tufts at their fixed end. The connecting elements are intended to serve for secure connection of the bristle tufts in the base carrier, as according to the description of EP-0 923 326 there was insufficient strength to prevent extraction of the tufts with the brush head already known from WO-A-96/02165, where the bristle tufts are embedded directly in the soft elastic material.

In view of this, it is proposed with EP-0 923 326 B1 that the fixed ends of the bristle tufts are anchored in the holders. In the production of toothbrushes, bristle tufts are commonly fixed in the head by a metal clip called an "anchor". Typically a bundle of bristles is folded in half, the anchor is clamped around the folded part of the bundle, and the anchor is inserted in a receiving opening in the head. An alternative technology is so called "anchorless" fixing of bristles into the head, in which the lower ends of a bundle of bristles are fused and allowed to set as an enlarged mass, which is then embedded directly in the plastic material of the head. This process is typified in EP-A-0 142 885, amongst many others.

The holders provided for anchorage of the bristle tufts in EP-0 923 326 B1 must be closed on their bottom side for insertion of such an anchor and, with a view to secure abutment of the metal anchors, must have a certain material strength. In addition, for alignment of the individual bristle tufts parallel to the axis it is necessary for the holder to have a certain axial length. These requirements result in certain restrictions in the design of the brush head, which, particularly in the case of the design of a brush head for a toothbrush, prove disadvantageous. In toothbrushes, bristle tufts are usually provided close to one another on the brush head. Also, in view of use in the mouth, the brush head should have as small a height as possible.

EP-A-0 159 940 discloses an elastic arrangement of the bristle tufts when subjected to compression loading along the longitudinal axis of individual tufts in which a gel cushion is placed at the rear of a uniform retaining plate having a plurality of channels, each for one bristle tuft, the said gel cushion being clamped between the retaining plate and a rear wall of the brush head. Owing to the elasticity of the gel cushion, the individual bristle tufts along the axis of the channels can move downwards in the direction of the brush head when subjected to excessive axial loading. In the embodiment according to EP-0 159 940 the retaining plate is clamped in a brush head under an intermediate layer of an elastic membrane. Between the membrane and the rear wall of the brush head there is a free space into which the individual bristle tufts can move. Both the known proposed solutions have been unsuccessful, however, because of the considerable height of the bristles and the complex arrangement. Also, due to the various layers located in the brush head, hygiene problems arise because bacteria, and in particular moisture, collect at the phase boundaries between the individual layers. Furthermore, the brush head in both embodiments has ventilation channels extending up into the interior by which the change in volume inside the brush head resulting from compression of the gel cushion or deformation of the membrane is to be compensated. It is these ventilation channels in particular which prevent a suitable development of the known toothbrush in terms of hygiene requirements.

U.S. Pat. No. 3,082,457 discloses a toothbrush in which individual bristle tufts are threaded through grommets and are supported in cup-like holders formed in a thin elastic diaphragm, these cups being themselves retained in cavities in a rigid toothbrush head.

The present invention is based on the problem of improving a brush head of the type stated at the beginning whilst avoided the above-mentioned problems of the state of the art. In particular the present invention is based on the problem of identifying a brush head of the type stated at the beginning which permits a small height and an arrangement of the tufts in very close proximity. Further problems addressed by this invention, and solutions provided, and other advantages of this invention, will be apparent to the skilled reader from the following description.

The present invention provides a head for a brush, in particular a toothbrush, with a base carrier formed from a soft elastic material and in which there are embedded connecting elements separated from one another and bearing a plurality of bristle tufts, each of the said connecting elements embracing individual bristle tufts on the anchorage side, characterised in that the connecting element is formed by a support ring through which the bristle tuft protrudes and in that the bristle tuft is safeguarded from extraction from the support ring by abutment between the lower end of the bristle tuft and the support ring.

The base carrier is preferably formed from a soft elastic material being a thermoplastic elastomer (TPE), many of which are known in the art as being suitable for use in the heads of toothbrushes. Suitably the base carrier is in the form of a pad of the soft elastic material of dimensions such that plural support rings may be embedded therein in a 2-dimensional array and a thickness greater than the axial dimension of the rings.

This brush head differs from the state of the art brush heads in that the connecting element is formed by a support ring through which the bristle tuft passes, and in that the tuft is safeguarded against extraction from the support ring by abutment between the anchorage-side end of the bristle tuft and the front-side end of the support ring. Unlike the state of the art, the present invention therefore proposes as a connecting element not a holder but a support ring which is open ended in an axial direction.

A support ring within the meaning of the present invention includes any tubular component provided with an unobstructed axial opening. About such an axis neither the radially outer perimeter nor the inner perimeter of the opening need be circular, but a cylindrical symmetry is preferred. The support ring may have an axial extension greater than its radial extension, e.g. a cylinder, or an axial extension less than its radial extension e.g. a toroid. As the support ring may be the element of the brush head primarily responsible for retaining the tuft in the soft elastic material it is preferred that the soft elastic material is connected securely with the support ring.

For example the support ring may be made of a material, typically a plastics material, which bonds well with the soft elastic material. It is well known in the art of making toothbrushes that common plastics materials used in toothbrush manufacture such as polypropylene can bond strongly to certain soft elastic thermoplastic elastomers which have for a long time been used to make soft elastic parts of toothbrushes, such as grip pads, gum-massage parts etc. Such bonding overcomes the problem of e.g. U.S. Pat. No. 3,082,547 in which mechanical wedging of grommets into the sockets in the rigid head is used to retain the diaphragm in the sockets, by enabling the soft elastic material to be injected into contact with the support rings in a hot fluid state and thereby achieve a bond. This actual bonding between the rings and the soft elastic material enable the rings to be embedded in the soft elastic material, particularly when the soft elastic material has a thickness such that all or a substantial pat of the rings may be embedded in the soft elastic material.

In view of the preference for the thickness of the head to be as small as possible, however, plate-shaped support rings are preferred which optionally are completely embedded in the soft elastic material.

Individual support rings may be connected to each other only by the soft elastic material between them. Alternatively two or more, up to all, of the support rings may be connected together by integral connecting webs made of the same material as the rings themselves.

The soft elastic material may be exposed as the outer surface of the brush head. For example the soft elastic material may be exposed at the upper surface of the brush head, and/or at the lower surface of the brush head. For example the soft elastic material may enclose, e.g. cover, the lower ends of the bristle tufts which extend through the support ring.

Therefore it is preferred that the soft elastic material is connected securely with the support ring and encloses the lower end of the bristle tuft on the lower side of the support ring.

The lower end of the bristle tuft need not be located in the connecting element, i.e. within the ring itself, but may be located adjacent the lower side of the support ring through which the bristle tufts protrude. The lower end of the tuft may be in contact with the lower side of the support ring, or a short distance below this lower side. In view of the need for strong retention of the bristle tufts to prevent them from being pulled out, the tufts are each held at the lower side of the support rings by abutment, that is, a part of the bristle tuft abuts against the support ring, particularly the lower surface of the support ring, if the tuft is moved upwards e.g. by a pulling force. This abutment is preferably achieved by a tuft being provided adjacent its fixed end with a bulge which radially exceeds the dimensions of the opening through the support ring and hence can abut against the support ring, e.g. against a downward-facing surface of the support ring. This bulge is preferably made by fusing the lower ends of the bristle tufts and allowing the fused ends to solidify to form the radially enlarged mass. For example these ends may be heated until they soften and then flow to form an enlarged mass or may be pressed against a surface. Alternatively the bulge may be provided by an anchor at or adjacent to the lower ends of the tufts.

The fixed ends of the bristle tufts, e.g. the bulge, are preferably embedded in the soft elastic material of the base carrier.

The lower surface of the support ring, especially the perimeter of the opening through the support ring, may be profiled e.g. concavely, so that the bulge may fit at least partially into the concave surface.

Furthermore, the brush head according to the invention offers the advantages over the state of the art, namely that the bristle tufts held in the individual support rings can be moved relatively freely to one another due to the soft elastic properties of the base carrier. This free mobility is produced by the connecting elements being embedded separately from one another in the base carrier. Several modes of movement are available to the bristle tufts. If individual support rings are connected to each other only by the soft elastic material between them this allows the support rings, and hence the tufts retained by them, to move relative to each other as the soft elastic material easily deforms under brushing pressure.

However the head construction of the invention provides a further mode of movement in which the bristle tuft can move axially, i.e. reciprocally upwards and downwards, within the support ring. This axial movement can be facilitated if there is radial clearance between a tuft and the sides of the opening through the support ring, or if the friction between the material of the support ring and the tuft is small. In such a situation if the soft elastic material encloses the lower end of the bristle tufts then the soft elastic material may resiliently support the bristle tuft in this axial movement. For example if the bristle tuft is caused to move downwardly axially under downward pressure applied to the bristle tuft, then the resilience of the soft elastic material tends to resist this movement, then on release of the pressure the resilience of the material tends to return the bristle tuft upwardly.

In a preferred construction based on the above, the soft elastic material is in the form of a pad having an upper surface, and having a lower surface, and a thickness dimension between these two surfaces, the bristle tufts extending above the upper surface, the bristle tufts being provided with a bulge adjacent their lower end, the thickness of the pad being such that the bulges are enclosed within the pad, the bristle tufts being able to move axially within the support rings. The lower surface of such a pad may be exposed as an outer surface of the toothbrush head.

In such a pad 50% or more of the axial length of the rings may be embedded. Part of the axial length of the rings may consequently project above the upper surface of the pad. This upper part of the rings, projecting above the upper surface, can help to guide, support and stabilise the tufts.

As the lower end of the bristle tuft can be outside the support ring, the brush head can be designed with a small thickness. Since, also, the support rings act as a stop in the event of an extraction force acting on the bristle tufts, the support rings can be designed with a low wall strength, so that in the brush head according to the invention the individual bristle tufts can be placed closer to one another. Unlike the proposed solutions known from EP-A-0 159 940 the brush head according to the invention offers the opportunity to combine a small height with high flexibility of the individual bristle tufts. The preferred construction of the invention also overcomes the problems of U.S. Pat. No. 3,082,457 in that the pad can be made thick enough, e.g. 2-5 mm that the rigid supporting head can be omitted, and the pad may be supported only around part or whole of its perimeter.

A toothbrush incorporating the brush head of the invention may incorporate a support for the base carrier, for example a supporting frame made of a plastics material. Suitably such a frame allows the base carrier, particularly a pad as described above, to flex in the axial direction of the bristle tufts.

Otherwise the toothbrush may be conventional.

Processes by which the brush head of this invention may be made will be apparent to those skilled in the art. Such a process may involve:

(1) forming plural bristles into a bundle;

(2) threading the bundle through an opening in an already-formed support ring so that an end of the bundle protrudes beyond the support ring;

(3) fusing the end of the bundle into an enlarged mass;

(4) with the fused end adjacent to the support ring, embedding the support ring in a mass of soft elastic material to form the base carrier.

The present invention is described by way of example only below, with reference to the drawings. In these drawings.

LIST OF REFERENCE NUMBERS

Figure 1:
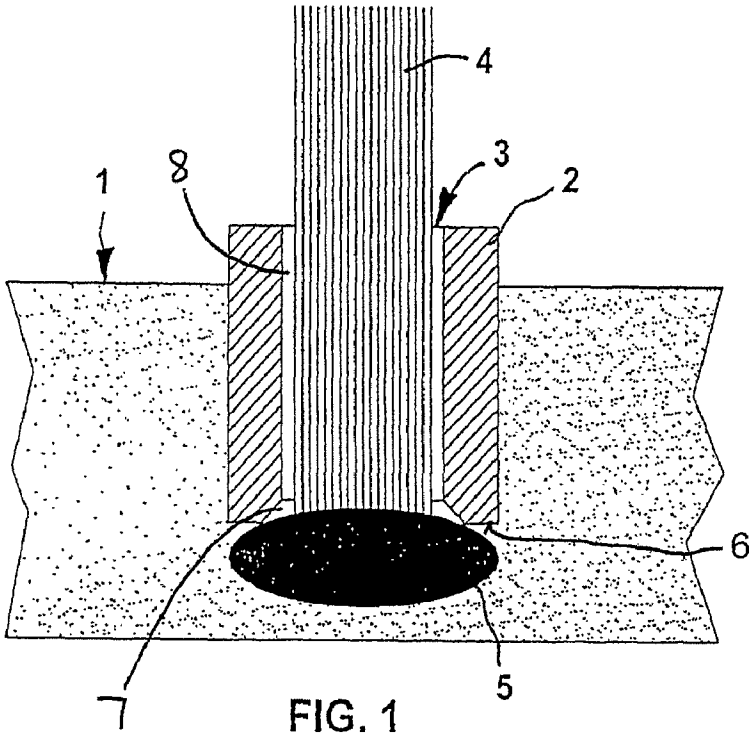
FIG. 1 shows a cross-sectional view through part of an embodiment of a brush head according to the invention in a starting position.

1 Base carrier
2 Support ring
3 Opening
4 Bristle tuft
5 Bulge
6 Lower surface of ring
7 Conical concavity
8 Radial clearance
9 Arch of elastic material
10 Toothbrush head
11 Toothbrush handle
12 Support frame The essential parts of an embodiment of a brush head according to the invention are shown in FIG. 1. The brush head comprises a base carrier 1 in the form of a pad which is formed from a soft elastic material, particularly a thermoplastic elastomer (TPE). The pad 1 has an upper surface A, a lower surface B, and a thickness T. In a toothbrush application of particular interest here this base carrier is connected to the head area of a toothbrush handle, which is not shown in FIG. 1. Depending on the individual demands placed on the cleaning characteristics of the toothbrush, a plurality of support rings 2 are distributed over the base carrier 1 and embedded therein. Each of the support rings 2 is provided as a separate component in the base carrier 1, i.e. not being connected to any other ring 2 except by the material of carrier 1.

The support rings 2 are designed as cylindrical components, i.e. small tubes longer than their diameter, and form a cylindrical unobstructed axial opening 3. But the rings 2 and openings 3 may be of any cross-section, e.g. round, polygonal or rectangular cross-sectional shape. The support rings 2 are preferably formed from polypropylene (PP), which bonds well with TPE.

Each ring 2 accepts a bristle tuft 4 consisting in a known way of a bundle of polyamide filaments, which is threaded through the opening 3 of the ring 2. One end, the lower end, of the bristle tufts extending beyond the support ring 2 has a bulge 5 which is formed by heat fusing the polyamide filaments into a mass which connects all the individual filaments of the bundle with one another. The bulge 5 has a diameter which is greater than the width of the axial opening 3 of the support ring 2. This bulge may be formed by allowing the melted filament material to flow naturally to form the bulge 5, alternately the bulge 5 may be formed by bringing the heat-softened material of the filaments into contact with a pressure surface.

The lower surface 6 of the support ring 2 around the perimeter of the opening 3 is profiled concavely at 7 e.g. conically, so that the bulge 5 may fit at least partially into the concave surface.

It is seen in FIG. 1 that the tufts are each held at the lower side of the support rings by abutment so that if the tuft is moved upwards e.g. by a pulling force the bulge 5 abuts against the lower side 6 of the support ring 2.

Figure 2:
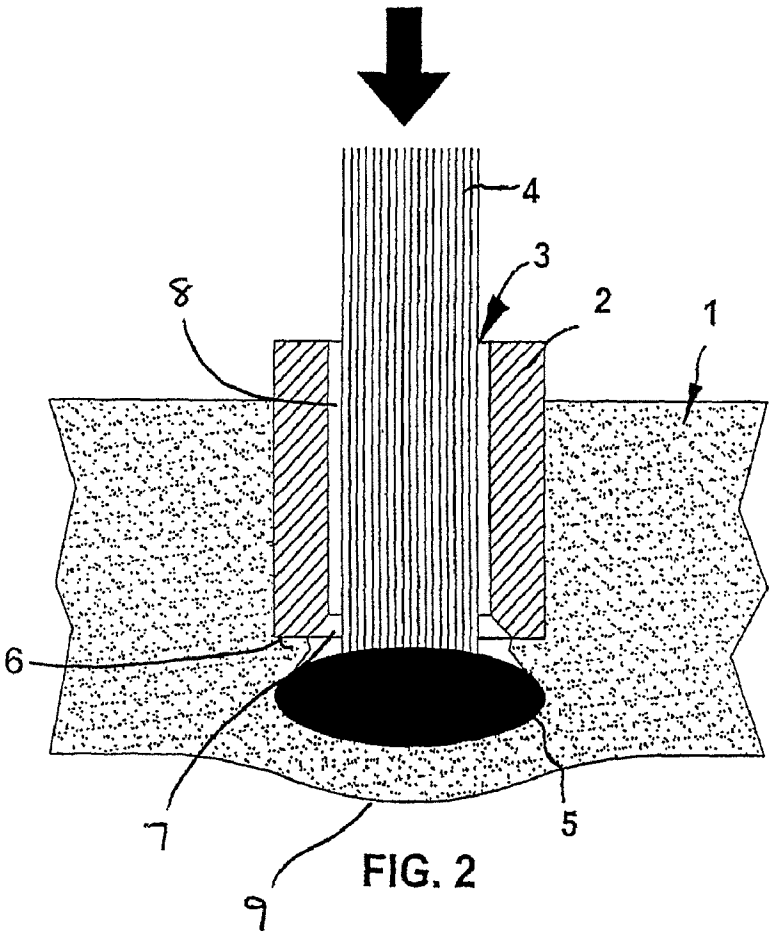
FIG. 2 shows the section depicted in FIG. 1 during axial loading of a bristle tuft.

Furthermore there is a radial clearance 8 between a tuft 4 and the sides of the opening 3 through the support ring 2 so the bristle tuft 4 may move axially within the support ring 2 under pressure applied in the direction of the arrow seen in FIG. 2. Friction between the polypropylene rings 2 and bristle bundles 4 is also low.

The individual support rings 2 are covered on their lower side by the soft elastic material of the base carrier 1. Accordingly the soft elastic material of the base carrier 1 forms the rear exterior of the brush head shown, said exterior being completely smooth. The brush head has a thickness T, however, which is only marginally higher than the embedding depth of the individual bristle tufts 4, i.e. the longitudinal section of the bristle tuft 4 surrounded by the base carrier 1, including the bulge 5. The thickness T of the pad 1 is such that the bulges 5 are enclosed within the pad 1, the bristle tufts 5 being able to move axially within the support rings 2.

Owing to the elastic properties of the soft elastic material, as well as the low wall strength of the base carrier 1 between the rear exterior and the lower end of the bristle tuft 4, the lower end of the bristle tuft 4 can be displaced against the resilience of the soft elastic material within limits as the tuft 4 moves in the axial direction relative to the support ring 2 as shown in FIG. 2. The soft elastic plastic of the base carrier 1 located at the rear of the bulge 5 forms a slight arch 9 with this type of loading at the rear of the brush head. On release of the pressure which has caused this downward axial movement the resilience of the soft elastic material causes the arch 9 to return upwardly to move the tuft 4 upwardly back to the position shown in FIG. 1. The soft elastic material in the region 9 therefore cushions the bristle tufts 4.

Figure 3:
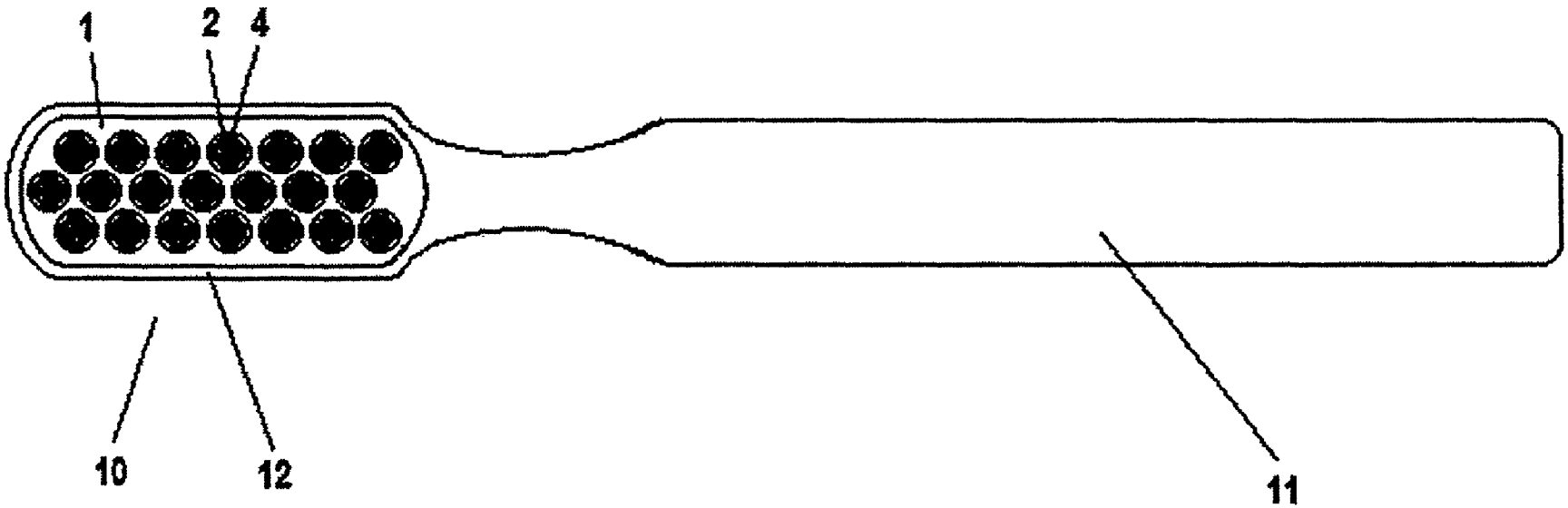
FIG. 3 shows a plan view of a typical construction of a toothbrush of this invention.

In the toothbrush of FIG. 3 the view is looking downwards onto the upper surface of the base carrier 1. The individual rings 2 enclosing tufts 4 are visible. The toothbrush comprises a head 10 and a handle 11, and the head comprises a ring-shaped support frame 12 for the perimeter of base carrier 1. The frame 12 may support all or part of the perimeter of base carrier 1.

The invention claimed is:

1. A head for a toothbrush, with a base carrier comprising a pad of a soft thermoplastic elastic material and in which there are embedded connecting elements made of a plastics material which is bonded with the soft elastic material and which are separated from one another said head bearing a plurality of bristle tufts, each of the said connecting elements embracing individual bristle tufts wherein the connecting element is formed by a support ring defining an opening therethrough, and through which ring the bristle tuft protrudes, and the bristle tuft is safeguarded from extraction from the support ring by abutment between the lower end of the bristle tuft and the support ring, and wherein the ends of the bristle tufts are also embedded in the soft elastic material of the carrier.

2. A head according to claim 1 wherein at least 50% of the axial length of the support ring is embedded in the soft elastic material of the base carrier.

3. A head according to claim 1 wherein individual support rings are connected to each other only by the soft elastic material between them.

4. A head according to claim 1 wherein the soft elastic material covers the lower ends of the bristle tuft which extends through the support ring, on the lower side of the support ring.

5. A head according to claim 4 wherein a bristle tuft is provided at its fixed end with a bulge which radially exceeds the dimensions of the opening through the support ring and can abut against the support ring.

6. A head according to claim 1 wherein the lower end of the bristle tuft is located adjacent the lower side of the support ring through which the bristle tuft protrudes.

7. A head according to claim 6 wherein the lower end of the tuft is in contact with the lower side of the support ring, or a short distance below this lower side.

8. A head according to claim 7 wherein the lower surface of the support ring is profiled concavely.

9. A head according to claim 1 wherein the bristle tuft can move axially within the support ring.

10. A head according to claim 9 wherein the soft elastic material encloses the lower end of the bristle tufts and resiliently supports the bristle tuft in the axial movement.

11. A head according to claim 1 wherein the base carrier is in the form of a pad of the soft elastic material having an upper surface and having a lower surface, and a thickness dimension between these two surfaces, the bristle tufts extending above the upper surface, the bristle tufts being provided with a bulge adjacent their lower end, the thickness of the pad being such that the bulges are enclosed within the pad, the bristle tufts being able to move axially within the support rings.

12. A toothbrush incorporating a brush head according to claim 1 incorporating a support for the base carrier.

13. A toothbrush according to claim 12 wherein the support allows the base carrier to flex in the axial direction of the bristle tufts.

* * * * *